US012310424B1

(12) United States Patent
Yardley

(10) Patent No.: US 12,310,424 B1
(45) Date of Patent: May 27, 2025

(54) MULTI-LAYERED UNDERGARMENT GUSSET SYSTEM

(71) Applicant: Anna Yardley, American Fork, UT (US)

(72) Inventor: Anna Yardley, American Fork, UT (US)

( * ) Notice: Subject to any disclaimer, the term of this patent is extended or adjusted under 35 U.S.C. 154(b) by 0 days.

(21) Appl. No.: 18/651,006

(22) Filed: Apr. 30, 2024

Related U.S. Application Data

(60) Provisional application No. 63/499,304, filed on May 1, 2023.

(51) Int. Cl.
*A41B 9/00* (2006.01)
*A41B 17/00* (2006.01)

(52) U.S. Cl.
CPC ..... *A41B 9/004* (2013.01); *A41B 9/001* (2013.01); *A41B 17/00* (2013.01); *A41B 2300/35* (2013.01)

(58) Field of Classification Search
CPC ..... A41B 9/004; A41B 9/002; A41B 9/04; A41B 9/12
See application file for complete search history.

(56) References Cited

U.S. PATENT DOCUMENTS 3,909,847 A * 10/1975 Holt ..... A41D 1/088 2/466
4,875,236 A * 10/1989 Boynton ..... A41D 7/00 2/403
4,956,878 A * 9/1990 Boynton ..... A41D 7/00 450/11
5,081,716 A * 1/1992 Lehenbauer ..... A41D 31/18 2/400
5,388,275 A * 2/1995 Oram ..... A41D 1/088 2/406
5,533,212 A * 7/1996 Moretz ..... A41B 11/14 2/409
6,610,901 B2 * 8/2003 McMahon-Ayerst ..... A61F 13/66 604/378
6,681,407 B2 * 1/2004 Martz ..... A41B 9/04 2/400
6,807,685 B1 * 10/2004 Hasegawa ..... A61F 13/505 2/400

(Continued)

FOREIGN PATENT DOCUMENTS

WO 2015163772 A2 10/2015
WO 2022050672 A1 10/2022

*Primary Examiner* — Alissa L Hoey

(57) ABSTRACT

A multi-layered undergarment gusset system includes a first layer forming an inner surface, a second layer forming an outer surface, a multi-layered gusset insert disposed between the first and second layers, and a serged portion. The multi-layered gusset insert has a first and second material, where the first material includes a stiff, impermeable, synthetic leather fabric resistant to bending, and the second material includes a soft, breathable, three-dimensional mesh spacer fabric. The first material's perimeter is smaller than a corresponding perimeter of the second material, and the first material is fixed in a central position to an outer surface of the second material via stitching. The serged portion of the second layer extends from the second layer and is secured over a first and second side of the first layer to enclose the multi-layered gusset insert between the first and second layers, and keep it in a fixed position.

11 Claims, 7 Drawing Sheets

(56) References Cited

U.S. PATENT DOCUMENTS 7,669,248 B2 * 3/2010 Toratani ..... A41D 7/005 2/400
8,460,265 B1 * 6/2013 Calender ..... A61F 13/49006 604/385.15
8,499,364 B2 8/2013 Dye
9,023,000 B2 * 5/2015 El-Miniawi ..... A61F 13/476 604/385.03
9,060,863 B2 * 6/2015 Zaltsberg ..... A61F 13/49017
9,301,550 B2 * 4/2016 Sabin ..... A41D 1/06
9,713,351 B2 * 7/2017 Wexler ..... A41D 1/06
10,441,480 B2 * 10/2019 Griffiths ..... A61F 13/49406
11,154,431 B1 * 10/2021 Yip ..... A41B 17/00
11,229,241 B2 1/2022 Adams
11,330,847 B2 * 5/2022 Etienne ..... A41D 7/005
11,395,774 B2 * 7/2022 Skinner ..... A61F 13/49006
11,523,641 B2 * 12/2022 Williams ..... A41D 1/084
11,553,739 B2 * 1/2023 Henry ..... A41D 1/08
11,701,267 B2 * 7/2023 Greco ..... A41D 7/005 604/383
11,752,043 B2 * 9/2023 Siriwardene ..... A61F 13/15707 2/400
11,752,049 B2 * 9/2023 Kajanthan ..... A61F 13/49446 604/359
11,896,063 B2 * 2/2024 Hanson Allen ..... A41B 9/004
11,911,247 B2 * 2/2024 Hopkins ..... A61F 13/53418
11,937,652 B2 * 3/2024 Gilbert ..... A41D 1/08
12,089,661 B2 * 9/2024 Ibrahim ..... A41B 9/004
2004/0230175 A1 * 11/2004 Rainville-Lonn ..... A61F 13/74 604/385.01
2010/0152687 A1 * 6/2010 Carlozzi ..... A61F 15/003 604/385.01
2011/0099693 A1 5/2011 Pratt
2012/0010582 A1 * 1/2012 Newnam ..... A61F 13/505 604/385.15
2013/0263362 A1 * 10/2013 Wexler ..... A41D 1/06 2/400
2014/0359920 A1 * 12/2014 Sabin ..... A41B 9/002 2/406
2016/0029703 A1 * 2/2016 Han ..... A41B 9/04 2/401
2016/0165959 A1 6/2016 Hayes
2016/0184146 A1 * 6/2016 Tulk ..... A01N 37/06 604/385.15
2017/0086509 A1 * 3/2017 Etienne ..... A41B 9/04
2019/0082744 A1 * 3/2019 Harley-LeGrand .... A41B 9/002
2019/0289921 A1 * 9/2019 Reil ..... A41B 17/00
2020/0008986 A1 * 1/2020 Hopkins ..... A61F 13/47254
2021/0007415 A1 * 1/2021 Sitt ..... A41D 27/12
2021/0177068 A1 * 6/2021 Karabetyan ..... A41B 9/023
2021/0368900 A1 * 12/2021 Ardoin ..... A41D 7/005
2022/0142265 A1 * 5/2022 Ardoin ..... A41D 7/005
2022/0408848 A1 * 12/2022 Krupa ..... A61F 13/15268
2023/0050850 A1 * 2/2023 Miller ..... A41B 9/12
2023/0157376 A1 * 5/2023 Towns-Scott ..... A41D 1/089 2/406
2023/0225437 A1 * 7/2023 Carlino ..... A41B 9/12 2/79
2024/0032609 A1 * 2/2024 Power ..... A41D 27/02
2024/0206564 A1 * 6/2024 Lenane ..... A41D 27/02
2024/0225155 A1 * 7/2024 Zirbel ..... A41B 9/004
2024/0261155 A1 * 8/2024 Ahmed ..... A41D 31/125

* cited by examiner

MULTI-LAYERED UNDERGARMENT GUSSET SYSTEM

RELATED APPLICATIONS

This application claims the benefit of U.S. Provisional Application No. 63/499,304, filed on May 1, 2023, the entire contents of which are incorporated by reference herein in their entirety.

TECHNICAL FIELD

Embodiments of the present disclosure relate to undergarment gusset systems, and in particular to multi-layered undergarment gusset systems.

BACKGROUND

Clothing is used on the body of a user. Clothing may be made of fabrics, textiles, animal skin, and/or sheets of materials. Clothing may be used as a barrier between the skin and the environment.

BRIEF DESCRIPTION OF DRAWINGS

The present disclosure is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one.

In consideration of the following detailed description, the embodiments may be more completely understood in connection with the following drawings.

DETAILED DESCRIPTION OF EMBODIMENTS

Figure 1A:
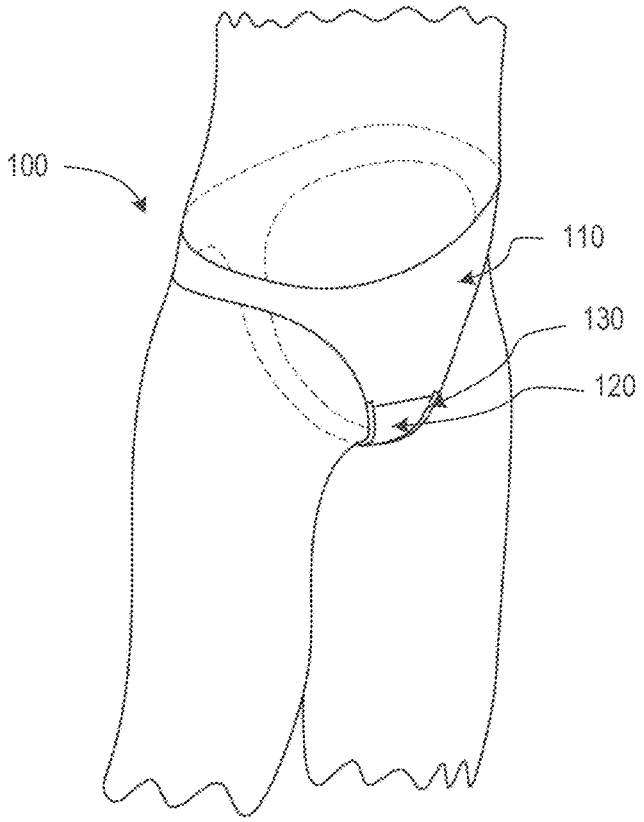
FIG. 1A illustrates a perspective view of a multi-layered undergarment gusset system, according to one or more embodiments.

Embodiments described herein are related to an undergarment gusset system (e.g., a multi-layered undergarment gusset system).

Clothing is used on the body of a user. Clothing may be made of fabrics, textiles, animal skin, and/or sheets of materials. Clothing may be used as a barrier between the skin and the environment. Clothing can be used as a protection from the environment (e.g., ultraviolet radiation, elements, rough surfaces, sharp elements, rash-causing plants, insect bites, etc.). Clothing can insulate against cold or hot conditions. Clothing can provide a hygienic barrier. In many parts of the world, not covering certain parts of the body (e.g., genitals, breasts, buttocks) with clothing in public may be considered embarrassing, may be against standards of appropriate behavior, and may be considered indecent exposure.

Clothing may reveal the outline of portions of the body. This may occur when portions of the clothing are in tension (e.g., tightly-fitting clothing, hiked-up clothing) and/or with materials made of certain materials (e.g., stretchy materials, synthetic fibers, etc.). For example, due to a combination of anatomical factors and fabric tension in the crotch area, an outline of the genitalia area (e.g., labia majora, penis and/or testicles, etc.) may become visible through clothing. The conforming of clothing to certain parts of the body may be uncomfortable, may cause embarrassment, and may be difficult to adjust and/or prevent.

Conventionally, a separate piece (e.g., hard piece) of material may be used as an insert in existing clothing (e.g., undergarments) to prevent revealing of the outline of portions of the body (e.g., genitalia area). This separate piece of material may move during use to reveal the outline of the portion of the body (e.g., genital area). The separate piece of material may cause friction on portions of the body (e.g., causing discomfort and pain). The separate piece of material may not be reusable, causing waste of material.

If a separate piece of material is not used, a user may be limited to the types of clothing that may be worn (e.g., certain sizes and materials of clothing, tighter or fitted clothing). The user may be limited in types of activity (e.g., activities that cause tension in the crotch area of the clothing). The user may be continuously adjusting clothing to avoid discomfort and to avoid revealing the outline of portions of the body (e.g., genitalia area). The user may undergo discomfort and revealing the outline of portions of the body (e.g., genitalia area).

The present disclosure solves these and other shortcomings of conventional solutions.

In some embodiments, a multi-layered undergarment gusset system includes a first layer, a second layer, a multi-layered gusset insert, and a serged portion. The first layer forms an inner surface of the multi-layered undergarment. The second layer forms an outer surface of the multi-layered undergarment. The multi-layered gusset insert is disposed (e.g., positioned, placed, located) between the first layer and the second layer. The multi-layered gusset insert includes a first material permanently coupled in a substantially central position to a second material via stitching. The multi-layered gusset insert is thicker than the first and second layers and is resistant to bending. The serged portion extends from the second layer and is secured over a first side of the first layer and a second side of the first layer. The serged portion encloses the multi-layered gusset insert between the first layer and the second layer, and keeps the multi-layered gusset insert in a substantially fixed position via a serger stitch.

The present disclosure has technical advantages over conventional solutions. In some embodiments, the present disclosure prevents discomfort and/or embarrassment of clothing conforming to portions of the body (e.g., genitalia area). The present disclosure avoids movements of a separate piece of material at portions of the body (e.g., genitalia area) of conventional solutions. The present disclosure avoids friction (e.g., and accompanying discomfort and pain) of a separate piece of material at portions of the body (e.g., genitalia area) of conventional solutions. The present disclosure may be reusable which reduces waste of material of conventional solutions.

Although some embodiments of the present disclosure describe multi-layered undergarments to prevent conforming of clothing to certain genitalia areas (e.g., labia majora), the present disclosure can be used to prevent conforming of clothing to other genitalia areas (e.g., penis and/or testicles, etc.) and/or other portions of the body (e.g., breasts, nipples, buttocks, injured portions of the body, abnormalities in the body, orifice in the body for medical tubing and/or equipment, etc.).

Although some embodiments of the present disclosure describe multi-layered undergarments to prevent conforming of clothing to portions of the body (e.g., genitalia areas), the present disclosure can be used as non-undergarments. For example, the present disclosure can be used as shorts, pants, swimming suits, protective gear, clothing that is used against the skin of the user, clothing that is used over undergarments, an outer layer of clothing, etc.

Although some embodiments of the present disclosure describe multi-layered undergarment gusset system, in some embodiments, the present disclosure is directed to a system that does not include a gusset.

Although some embodiments of the present disclosure describe using specific quantities (e.g., volumes, weights, periods of time, temperatures, lengths, thicknesses, etc.), in some embodiments, the present disclosure can use other quantities (e.g., within ±1%, within ±2%, within ±5%, within ±10%, within ±15%, within ±20%, within ±25%, etc. of the quantities described).

Reference will now be made to the drawings to describe various aspects of examples of the present disclosure. It is understood that the drawings are diagrammatic and schematic representations of such examples, and are not limiting of the present disclosure, nor are any particular elements to be considered essential for all examples or that elements be assembled or manufactured in any particular order or manner. No inference should therefore be drawn from the drawings as to the necessity of any element. In the following description, numerous specific details are set forth in order to provide a thorough understanding of the present disclosure. It will be obvious, however, to one of ordinary skill in the art, that the present disclosure may be practiced without these specific details. In other cases, well known aspects of baking equipment and methods, and general culinary techniques, are not described in detail herein in order to avoid unnecessarily obscuring the novel aspects of the present disclosure.

FIG. 1A illustrates a perspective view of a multi-layered undergarment gusset system 100, according to one or more embodiments. The multi-layered undergarment gusset system 100 may include a first layer 120, a second layer 110, a multi-layered gusset insert (see multi-layered gusset insert 140 of FIG. 1B), and a serged portion 130. In some embodiments, a multi-layered gusset insert is a piece of material sewn into and/or integral to clothing to strengthen a portion of the clothing, enlarge a portion of the clothing, prevent conforming of the clothing to a portion of the body (e.g., genitalia area, etc.).

In some embodiments, the first layer 120 forms an inner surface (e.g., the surface closest to the body) of the multi-layered undergarment. In some embodiments, the first layer 120 is a soft, breathable (e.g., air permeability ranging from about 5 to about 20 cubic centimeters per square centimeters per second ($cc/cm^2/s$)) fabric or material (e.g., cotton) configured to be a buffer between the body and the multi-layered undergarment gusset system and configured to provide airflow (e.g., between the body and the environment opposite the multi-layered undergarment gusset system from the body).

In some embodiments, the second layer 110 forms an outer surface (e.g., the surface furthest from the body) of the multi-layered undergarment gusset system. In some embodiments, the second layer 110 is a soft fabric or material (e.g., cotton, sateen, modal fabric, lace, etc.).

In some embodiments, the multi-layered gusset insert is disposed (e.g., positioned) between the first layer 120 and the second layer 110. In some embodiments, the multi-layered gusset insert includes a first material and a second material that is thicker than the first layer 120 and the second layer 110. In some embodiments, the multi-layered gusset insert includes a material that is resistant to bending (e.g., leather, pleather (imitation leather and/or polyurethane), synthetic leather, polyvinyl, etc.). The details regarding the multi-layered gusset insert will be explained in greater detail in relation to FIG. 1B, FIGS. 2A-C, and FIG. 3.

In some embodiments, the serged portion 130 may enclose the multi-layered gusset insert between the first layer 120 and the second layer 110. In some embodiments, the serged portion may be an extension of the second layer 110 that is secured over a first side 122 of the first layer 120 and a second side 124 of the first layer 120 (e.g., a portion of fabric that folds over from the second layer to the first layer). In some embodiments, the serged portion 130 may maintain the multi-layered gusset insert in a substantially fixed position via a serger stitch (e.g., the multi-layered gusset insert remains in a position where the multi-layered gusset insert is to prevent discomfort at and/or revealing of outline of the portions of the body, such as the genitalia area). In some embodiments, the serged portion 130 may include elastic in the first side 122 and the second side 124 between the first layer 120 and the second layer 110 to prevent the multi-layered undergarment gusset system from moving.

In some embodiments, the first layer 120 and the second layer 110 may be larger than the multi-layered gusset insert.

Figure 6A:
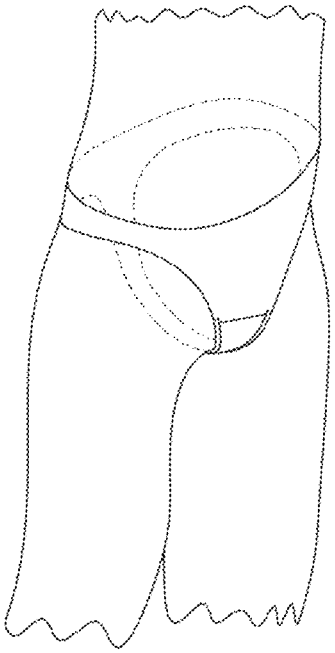
FIG. 6A, FIG. 6B, FIG. 6C, and FIG. 6D illustrate styles of a multi-layered undergarment gusset system, according to one or more embodiments.
Figure 6B:
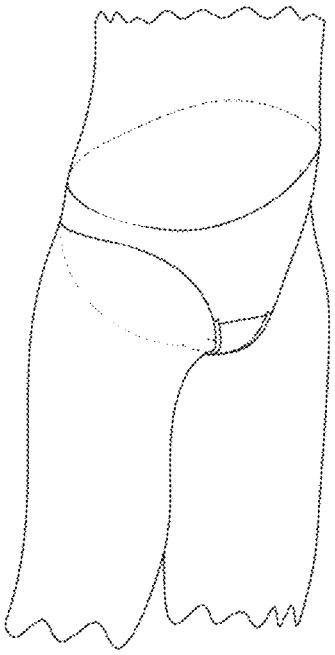
Figure 6C:
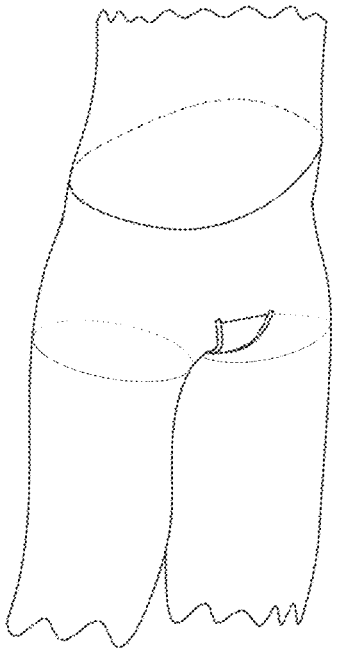
Figure 6D:
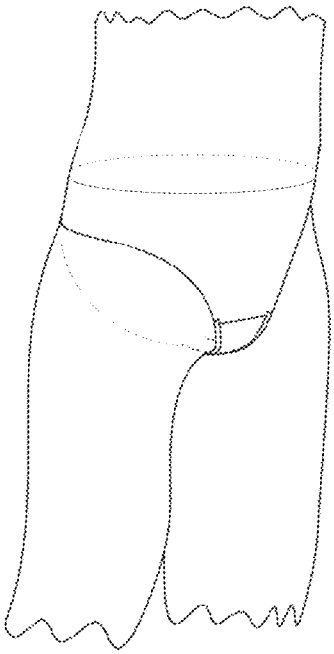

In some embodiments, the multi-layered undergarment gusset system may be used in a variety of undergarment sizes (e.g., extra-small (XS) through extra-large (XL) standard female sizing, men sizing, and/or child sizing) and styles (e.g., a thong, a brief, a boy short, a hipster, a high-waisted brief, etc.) where a front a rear panel are connected by a central panel to form a cohesive unit and attached to an elastic waistband to secure the undergarment around a wearer's waist. The multi-layered undergarment gusset system may be adapted for a variety of undergarments worn to cover the wearer's genital area and a rear portion providing coverage to the buttocks region. In some embodiments, undergarments may be worn directly under the wearer's clothing and directly proximate the skin, without additional layers between the skin and the undergarment or the undergarment and the wearer's outer clothing. A thong (see FIG. 6A) may be a type of undergarment characterized by a narrow strip of fabric that passes between the wearer's buttocks, typically connected to a waistband at the front, providing minimal rear coverage. A brief (see FIG. 6B) may be an undergarment characterized by full coverage to the wearer's genital area and buttocks, typically featuring a waistband and leg openings for secure and comfortable wear. A boy short (see FIG. 6C) may be an undergarment characterized by a close-fitting design with a low-rise waistband and extended leg openings that provide full coverage to the wearer's buttocks, resembling the shape of shorts. A high-waisted brief (see FIG. 6D) may be an undergarment characterized by a waistband positioned above the natural waistline, providing full coverage to the wearer's genital area and extending up to the mid- or high-waist region for enhanced support and shaping.

Figure 1B:
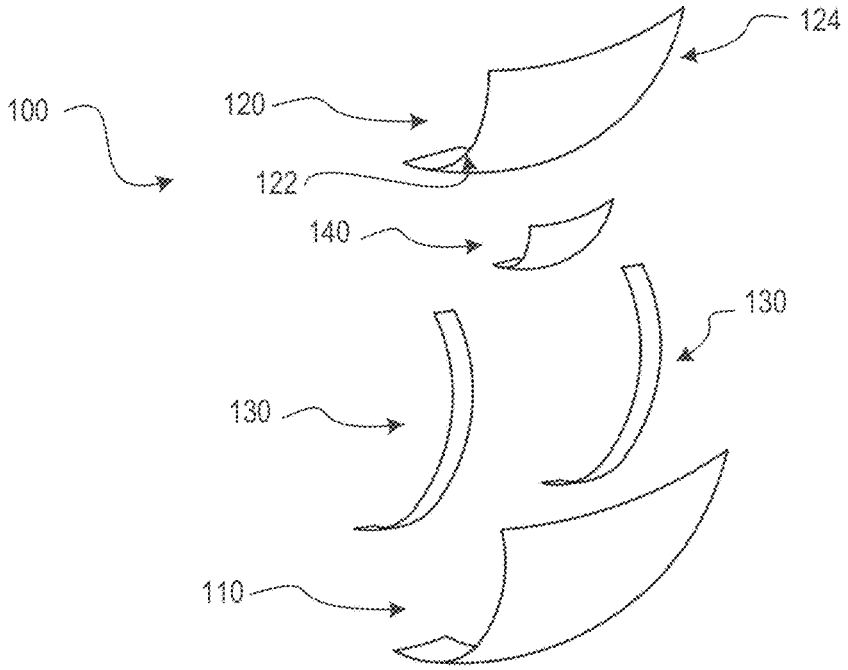
FIG. 1B illustrates an exploded perspective view of components of a multi-layered undergarment gusset system, according to one or more embodiments.

FIG. 1B illustrates components of a multi-layered undergarment gusset system 100, according to one or more embodiments. The multi-layered undergarment gusset system 100 may include a first layer 120, a second layer 110, a multi-layered gusset insert 140, and a serged portion 130.

In some embodiments, the multi-layered gusset insert is disposed (e.g., positioned) between the first layer 120 and the second layer 110. In some embodiments, the multi-layered gusset insert includes a first material and a second material that is thicker than the first layer 120 and the second layer 110. The components of FIG. 1B may be substantially the same as set forth in the above description of FIG. 1A.

Figure 2A:
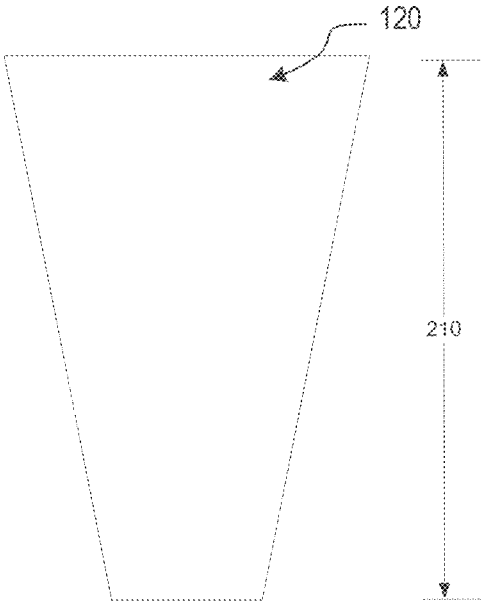
FIG. 2A illustrates a front view of a first layer of a multi-layered undergarment system, according to one or more embodiments.
Figure 2B:
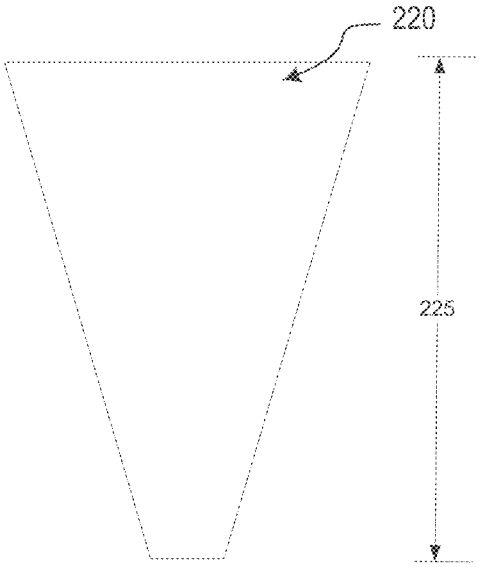
FIG. 2B illustrates a front view of a second material of a multi-layered gusset insert of a multi-layered undergarment gusset system, according to one or more embodiments.
Figure 2C:
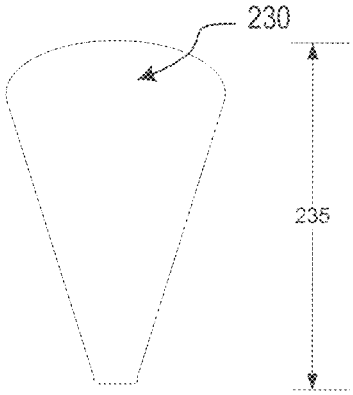
FIG. 2C illustrates a front view of a first material of a multi-layered gusset insert of a multi-layered undergarment gusset system, according to one or more embodiments.

FIGS. 2A-C illustrate a front view of various components of a multi-layered undergarment gusset system 100, according to one or more embodiments.

FIG. 2A illustrates a perspective view of a first layer 120 of a multi-layered undergarment gusset system 100, according to one or more embodiments. In some embodiments, the first layer 120 may have a length 210 of about 77 millimeters (mm) to about 87 mm. The components of FIG. 2A may be substantially the same as set forth in the above description of FIG. 1

FIG. 2B illustrates a front view of a second material 220 of a multi-layered gusset insert 140 of a multi-layered undergarment gusset system 100, according to one or more embodiments. In some embodiments, the second material 220 may have a length 225 of about 75 millimeters (mm) to about 82 mm. In some embodiments, the second material 220 may be a soft, breathable fabric or material (e.g., three-dimensional (3D) spacer fabric, 3D mesh, 3D mesh spacer) configured to be a buffer between the body and the first material 230 of the multi-layered gusset insert 140. A 3D mesh spacer may be a knitted spacer fabric. A knitted spacer fabric may be a textile material with a three-dimensional structure, consisting of two outer layers connected by spacer yarns, creating air pockets for enhanced breathability and comfort. Spacer yarns may be specialized threads inserted between layers of fabric during knitting to create gaps that enhance breathability and provide cushioning in the resulting fabric.

FIG. 2C illustrates a front view of a first material 230 of a multi-layered gusset insert 140 of a multi-layered undergarment gusset system 100, according to one or more embodiments. In some embodiments, the first material 230 may have a length 235 of about 50 millimeters (mm) to about 60 mm. In some embodiments, the first material 230 may be a stiff, substantially non-breathable (e.g., substantially impermeable to air, having air permeability of about 0 to about 5 $cc/cm^2/s$) fabric or material that is resistant to bending (e.g., synthetic leather, leather, pleather (imitation leather and/or polyurethane), polyvinyl, etc.).

Figure 3:
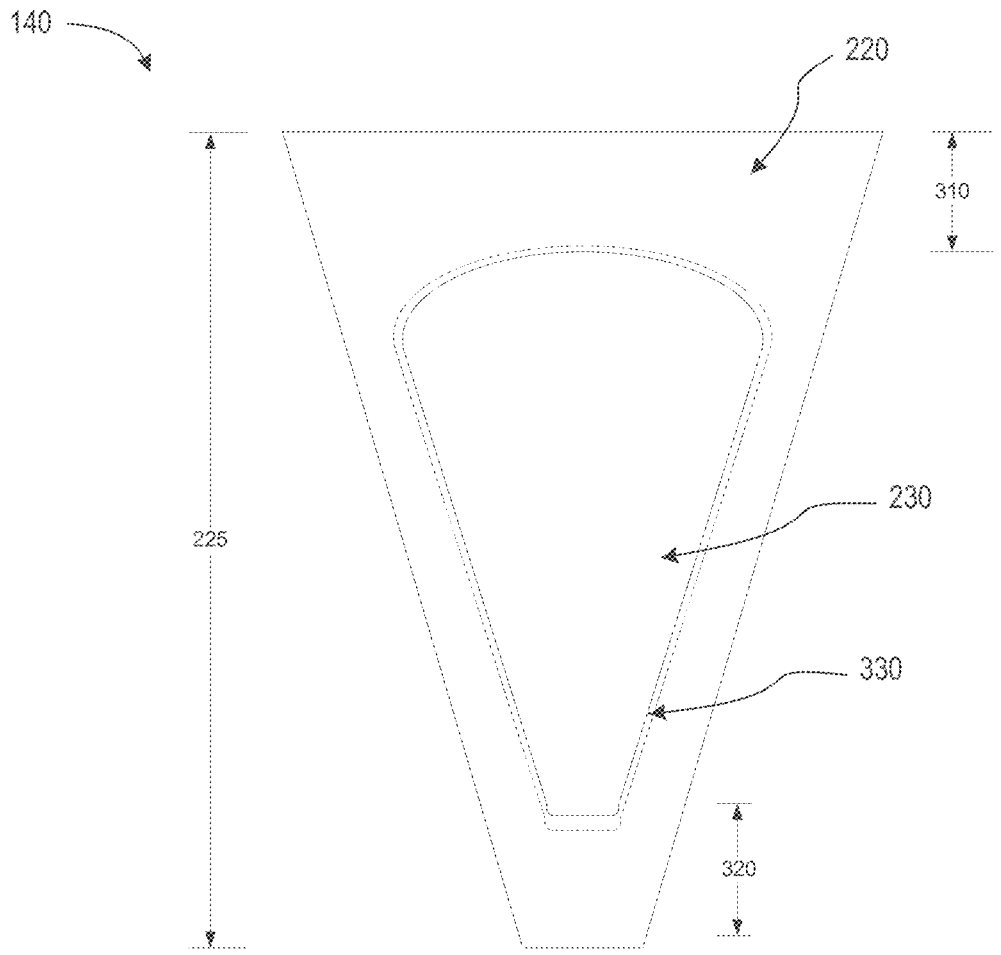
FIG. 3 illustrates a front view of a multi-layered gusset insert of a multi-layered undergarment gusset system, according to one or more embodiments.

FIG. 3 illustrates a front view of a multi-layered gusset insert 140 of a multi-layered undergarment gusset system 100, according to one or more embodiments. In some embodiments, the multi-layered gusset insert 140 may include a first material 230, a second material 220, and an insert surged portion 330. The components of FIG. 3 may be substantially the same as set forth in the above description of FIG. 1. In some embodiments, the first material 230 may be disposed (e.g., positioned) in a substantially central position (e.g., the distance 310 and the distance 320 are substantially equal) of the second material 220 and secured in a substantially fixed position (e.g., permanently couples the first material to the second material) via the insert surged portion 330. The insert surged portion 330 combines the first material 230 and the second material 220 and may create a uniform thickness around a perimeter of the first material (e.g., the thickness of the insert surged portion 330 is uniform to a corresponding thickness of the second material 220).

Figure 4A:
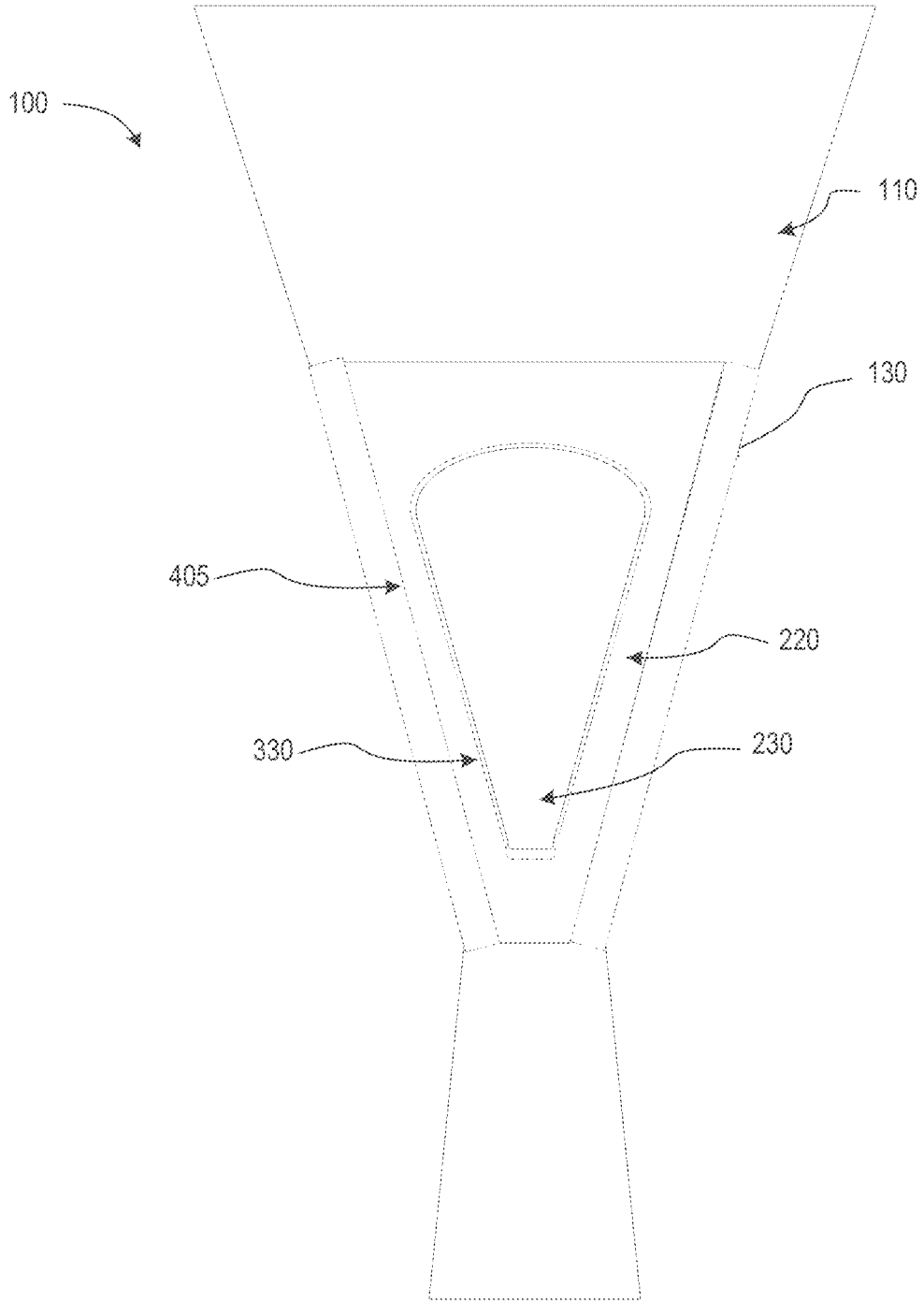
FIG. 4A illustrates an inner view of a multi-layered undergarment gusset without the first layer, according to one or more embodiments.
Figure 4B:
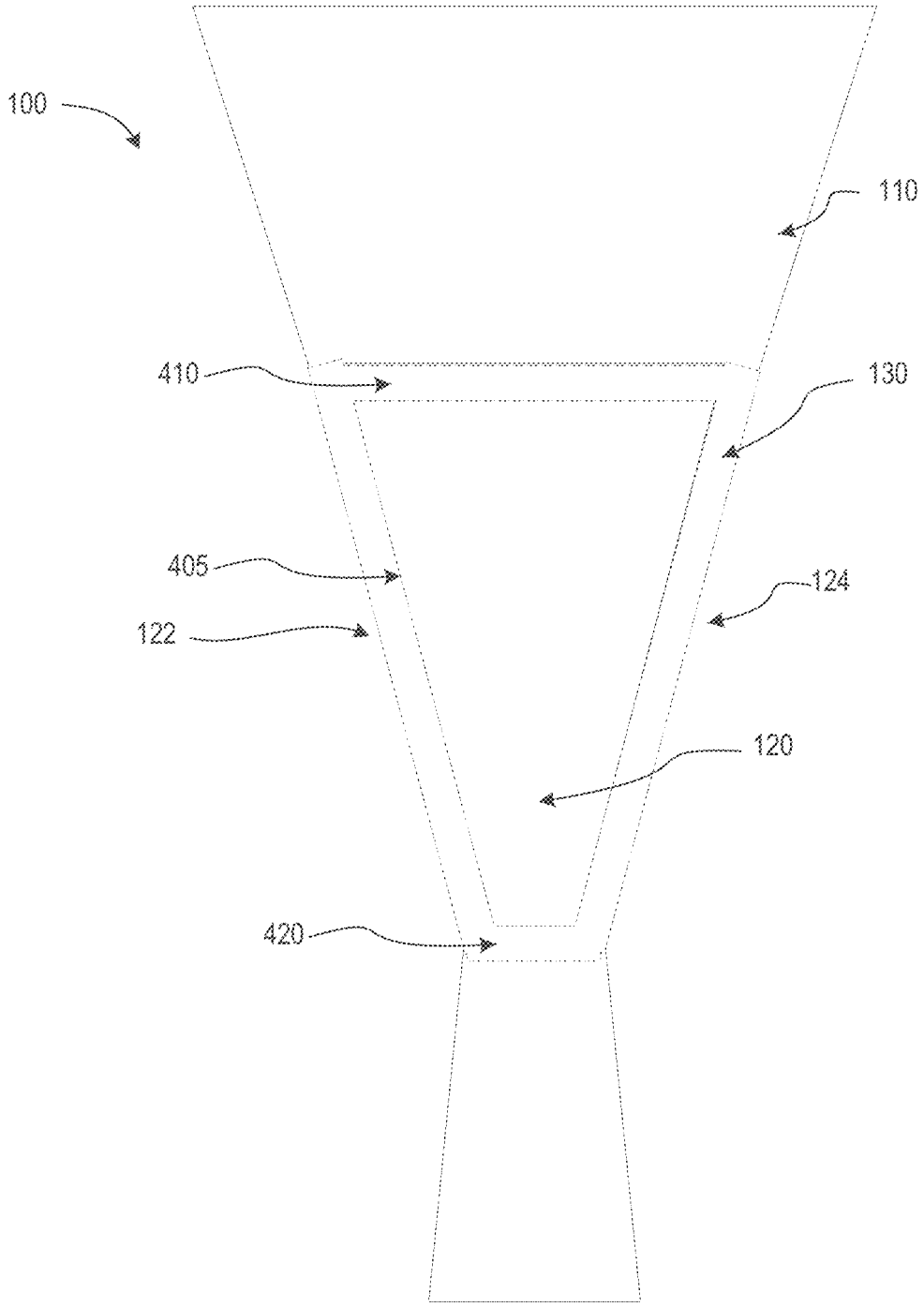
FIG. 4B illustrates an inner view of a multi-layered undergarment gusset with the first layer, according to one or more embodiments.

FIGS. 4A-B illustrate an inner view of a multi-layered undergarment gusset system 100, according to one or more embodiments.

FIG. 4A illustrates an inner view of a multi-layered undergarment gusset system 100 without the first layer 120, according to one or more embodiments. In some embodiments, the multi-layered undergarment gusset system 100 may include a second layer 110, a serged portion 130, and a multi-layered gusset insert 140 which may include a first material 230, a second material 220, and a serged portion 330. The multi-layered gusset insert 140 may be held in a substantially fixed position via a serger stitch 405. In some embodiments, the first material 230 and the second material 220 may each be an irregular quadrilateral shape. The components of FIG. 4A may be substantially the same as set forth in the above description of FIGS. 1-3.

FIG. 4B illustrates an inner view of a multi-layered undergarment gusset system 100 with the first layer 120, according to one or more embodiments. In some embodiments, the multi-layered undergarment gusset system 100 may include a second layer 110, a first layer 120, and a serged portion 130, with a multi-layered gusset insert enclosed between the first layer 120 and the second layer 110. In some embodiments, the first layer may be further secured to the multi-layered gusset insert and the second layer 110 via additional serged portions 410 and 420. In some embodiments, the first layer 120 and the second layer 110 may each be an irregular quadrilateral shape. The components of FIG. 4A may be substantially the same as set forth in the above description of FIGS. 1-3.

In some embodiments, the serged portion may only be on the second layer (e.g., on the cotton fabric). In some embodiments, the serged portion may include elastic. In some embodiments, the first layer (e.g., the spacer fabric) may end before the second layer is serged and sewn down to the multi-layered undergarment. In some embodiments, the multi-layered gusset insert (e.g., leather piece) may be the same size for a variety of styles of multi-layered undergarments.

Figure 5:
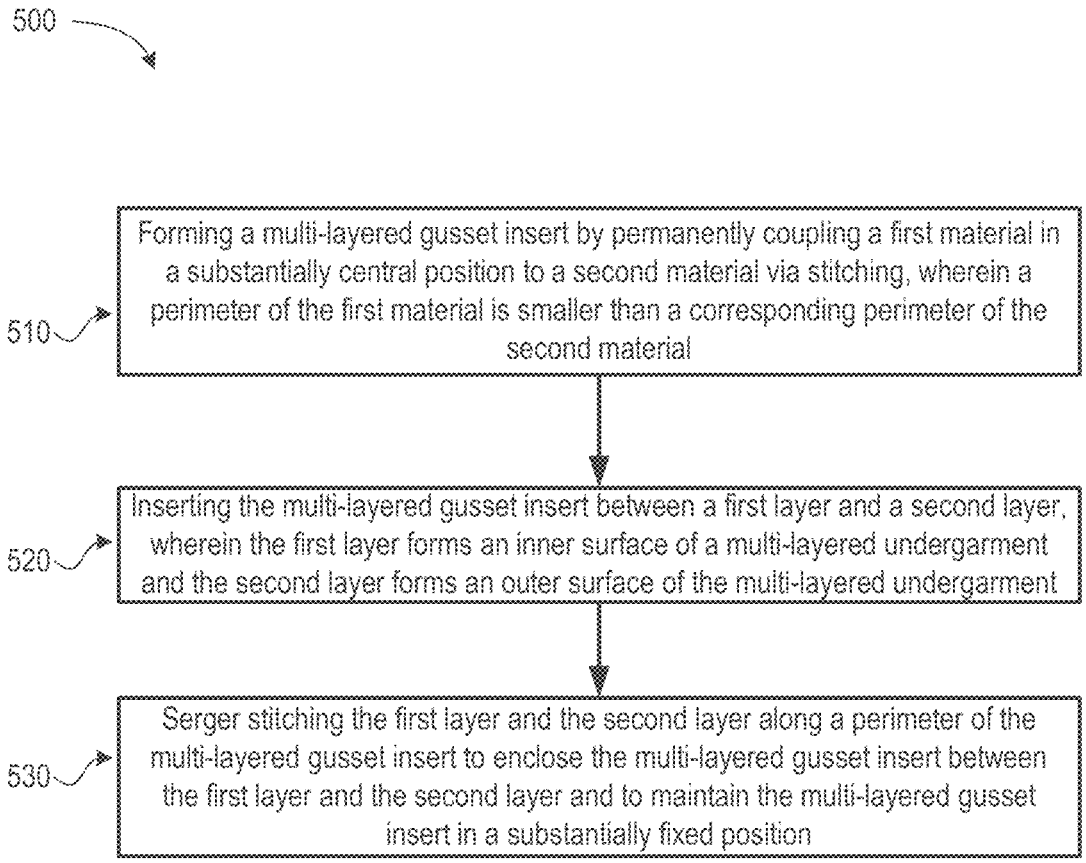
FIG. 5 illustrates a method of making a multi-layered undergarment gusset system, according to one or more embodiments.

FIG. 5 illustrates a method of making a multi-layered undergarment gusset system 500, according to one or more embodiments.

In some embodiments, at block 510, the method may include forming a multi-layered gusset insert by permanently coupling the first material in a substantially central position to the second material via stitching, wherein a perimeter of the first material is smaller than a corresponding perimeter of the second material.

In some embodiments, the first material may be about 50 millimeters (mm) to about 60 mm in length. In some embodiments, the first material may include synthetic leather. In some embodiments, the second material may be about 75 mm to about 82 mm in length. In some embodiments, the second material may include 3D mesh.

In some embodiments, at block 520, the method may include inserting the multi-layered gusset insert between a first layer and a second layer, wherein the first layer forms an inner surface of a multi-layered undergarment and the second layer forms an outer surface of the multi-layered undergarment.

In some embodiments, at block 530, the method may include serger stitching the first layer and the second layer along a perimeter of the multi-layered gusset insert to enclose the multilayered gusset insert between the first layer and the second layer and to maintain the multilayered gusset insert in a substantially fixed position.

In some embodiments, the surged portion may include a first side and a second side. In some embodiments, the first side and the second side may include elastic.

In some embodiments, the surged portion may include a first surged side and a second surged side. In some embodiments, the first surged side and the second surged side may include elastic.

The above description is intended to be illustrative, and not restrictive. Although the present disclosure has been described with references to specific illustrative examples and implementations, it will be recognized that the present disclosure is not limited to the examples and implementations described. The scope of the disclosure should be determined with reference to the following claims, along with the full scope of equivalents to which the claims are entitled.

The preceding description sets forth numerous specific details such as examples of specific systems, components, methods, and so forth in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular implementations may vary from these exemplary details and still be contemplated to be within the scope of the present disclosure.

The terms "over," "under," "between," "disposed on," and "on" as used herein refer to a relative position of one material layer or component with respect to other layers or components. For example, one layer disposed on, over, or under another layer may be directly in contact with the other layer or may have one or more intervening layers. Moreover, one layer disposed between two layers may be directly in contact with the two layers or may have one or more intervening layers. Similarly, unless explicitly stated otherwise, one feature disposed between two features may be in direct contact with the adjacent features or may have one or more intervening layers.

The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion.

Reference throughout this specification to "one embodiment," "an embodiment," or "some embodiments" means that a particular feature, structure, or characteristic described in connection with the embodiment is included in at least one embodiment. Thus, the appearances of the phrase "in one embodiment," "in an embodiment," or "in some embodiments" in various places throughout this specification are not necessarily all referring to the same embodiment. In addition, the term "or" is intended to mean an inclusive "or" rather than an exclusive "or." That is, unless specified otherwise, or clear from context, "X includes A or B" is intended to mean any of the natural inclusive permutations. That is, if X includes A, X includes B, or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Also, the terms "first," "second," "third," "fourth," etc. as used herein are meant as labels to distinguish among different elements and can not necessarily have an ordinal meaning according to their numerical designation. When the term "about," "substantially," or "approximately" is used herein, this is intended to mean that the nominal value presented is precise within ±10%.

It is understood that the above description is intended to be illustrative, and not restrictive. Many other embodiments will be apparent to those of skill in the art upon reaching and understanding the above description. The scope of the disclosure should, therefore, be determined with reference to the appended claims, along with the full scope of equivalents to which such claims are entitles.

What is claimed is:

1. A multi-layered undergarment gusset system comprising:

- a first layer that forms an inner surface of a multi-layered undergarment;
- a second layer that forms an outer surface of the multi-layered undergarment;
- a multi-layered gusset insert disposed between the first layer and the second layer, wherein the multi-layered gusset insert: comprises:
  - a first material comprising a synthetic leather that is a stiff and impermeable fabric that is resistant to bending; and
  - a second material comprising a three-dimensional (3D) mesh spacer and having an inner surface and an outer surface, wherein:
    - a perimeter of the first material is smaller than a corresponding perimeter of the second material; and
    - the first material is disposed on the outer surface of the second material and is permanently coupled in a substantially central position to the second material via stitching; and
- a serged portion of the second layer that extends from the second layer and is secured over a first side of the first layer and a second side of the first layer to enclose the multi-layered gusset insert between the first layer and the second layer, wherein the serged portion maintains the multi-layered gusset insert in a substantially fixed position via a serger stitch.

2. The multi-layered undergarment gusset system of claim 1, wherein the first material is 50 millimeters (mm) to 60 mm in length.

3. The multi-layered undergarment gusset system of claim 1, wherein the second material is 75 mm to 82 mm in length.

4. The multi-layered undergarment gusset system of claim 1, wherein the first layer comprises a cotton fabric.

5. The multi-layered undergarment gusset system of claim 1, wherein the second layer comprises a fabric permeable to air.

6. The multi-layered undergarment gusset system of claim 1, wherein a perimeter of the multi-layered gusset insert is smaller than a corresponding perimeter of the first layer, and wherein the perimeter of the multi-layered gusset insert is smaller than a respective perimeter of the second layer.

7. The multi-layered undergarment gusset system of claim 6, wherein the first layer is 77 mm to 87 mm in length.

8. The multi-layered undergarment gusset system of claim 1, wherein the multi-layered undergarment comprises one or more of a thong, a brief, a boy short, or a high-waisted brief.

9. The multi-layered undergarment gusset system of claim 1, wherein the serged portion further comprises elastic disposed between the first side of the first layer and the second layer and between the second side of the first layer and the second layer.

10. The multi-layered undergarment gusset system of claim 1, wherein the first material and the second material are each an irregular quadrilateral.

11. The multi-layered undergarment gusset system of claim 1, wherein a thickness of the stitching to permanently couple the first material to the second material is uniform to a corresponding thickness of the second material.

* * * * *